US010794590B2

(12) United States Patent
Estrada

(10) Patent No.: US 10,794,590 B2
(45) Date of Patent: Oct. 6, 2020

(54) BURNER SYSTEM HAVING A GAS DISTRIBUTION HUB AND ONE OR MORE BULLET-SHAPED GAS RELEASE NOZZLES

(71) Applicant: Lupe Estrada, Ontario, CA (US)

(72) Inventor: Lupe Estrada, Ontario, CA (US)

( * ) Notice: Subject to any disclaimer, the term of this patent is extended or adjusted under 35 U.S.C. 154(b) by 0 days.

(21) Appl. No.: 15/893,426

(22) Filed: Feb. 9, 2018

(65) Prior Publication Data

US 2019/0249868 A1 Aug. 15, 2019

(51) Int. Cl.

| | |
|---|---|
| ***F23D 11/38*** | (2006.01) |
| ***F23D 14/32*** | (2006.01) |
| ***F23D 14/22*** | (2006.01) |
| ***F23D 14/48*** | (2006.01) |

(52) U.S. Cl.

CPC ..... *F23D 11/38* (2013.01); *F23D 14/22* (2013.01); *F23D 14/32* (2013.01); *F23D 14/48* (2013.01)

(58) Field of Classification Search

CPC ..... F23D 14/22; F23D 11/38

USPC ..... 239/550, 556–560

See application file for complete search history.

(56) References Cited

U.S. PATENT DOCUMENTS

| | | | | | |
|---|---|---|---|---|---|
| 647,222 | A * | 4/1900 | Deiters | B05B 1/267 | 239/429 |
| 1,323,773 | A * | 12/1919 | Kendrick | F23D 14/04 | 239/557 |
| 1,394,721 | A * | 10/1921 | Festa | F23D 14/10 | 239/550 |
| 2,026,027 | A * | 12/1935 | Evans | F23D 14/045 | 239/429 |
| 2009/0202954 | A1* | 8/2009 | Tsung | F23D 14/48 | 431/153 |

* cited by examiner

*Primary Examiner* — Grant Moubry
*Assistant Examiner* — Aaron H Heyamoto
(74) *Attorney, Agent, or Firm* — FisherBroyles, LLP; Rob L. Phillips

(57) ABSTRACT

A burner system configured to distribute gas evenly to multiple gas release nozzles shaped to generate increased flame height and a more aesthetically pleasing and consistent flame.

9 Claims, 12 Drawing Sheets

BURNER SYSTEM HAVING A GAS DISTRIBUTION HUB AND ONE OR MORE BULLET-SHAPED GAS RELEASE NOZZLES

FIELD OF THE INVENTION

The embodiments of the present invention relate to a burner system configured to distribute gas evenly to multiple gas release nozzles shaped to generate increased flame height and a more aesthetically pleasing and consistent flame.

BACKGROUND

Fire features, such as fire pits and tables, are very popular and tend to serve as the center piece for social gatherings. One of the primary attractions of fire features are the flames created thereby. A fire feature with a short flame, inconsistent flame and/or unattractive flame is not attractive or marketable.

It would be advantageous to develop a burner system configured to distribute gas evenly to multiple gas release nozzles shaped to generate increased flame height and a more aesthetically pleasing and consistent flame.

SUMMARY

Accordingly, one embodiment of a burner system comprises: a gas hub configured to distribute gas to one more gas conduits; one or more gas release nozzles connected to said one or more gas conduits, said one or more gas release nozzles having a lower portion, intermediate portion and upper portion, said lower portion having a first gas channel therethrough, said intermediate portion and said upper portion having a second gas channel therethrough, said first gas channel and said second gas channel in communication with one other, said second gas channel having a smaller diameter than said first gas channel to compress gas as it passes through said intermediate portion and said upper portion, said upper portion having a gas exit opening configured to create a flat flame when gas exiting therethrough is ignited.

The burner system described herein may take on many different geometries (e.g., circular or star-shaped) to create unique fire features.

Other variations, embodiments and features of the present invention will become evident from the following detailed description, drawings and claims.

DETAILED DESCRIPTION

Figure 1A:
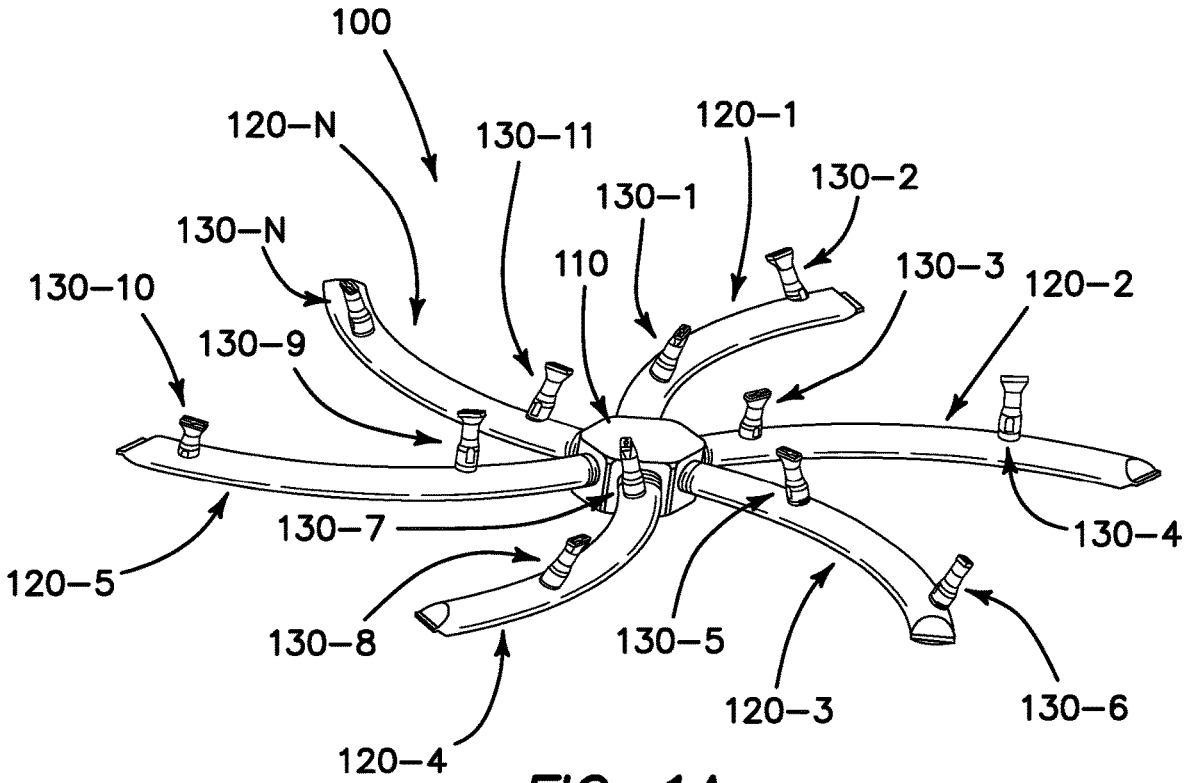
FIGS. 1A-1C illustrate upper perspective, top down and side views, respectively, of a star-shaped burner system according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the burner system detailed herein, may be fabricated of any number of materials including, but not limited to, metals, alloys, composites and combinations thereof. The components may be fabricated using techniques, including, but not limited to, machining, casting, milling, additive manufacturing, molding and combinations thereof.

Figure 1C:
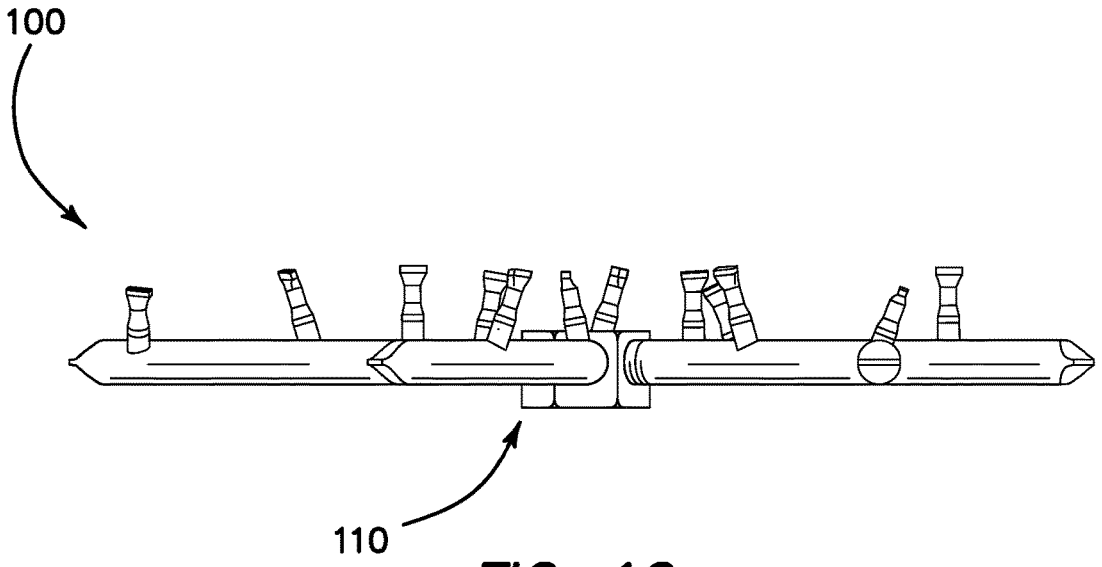
Figure 1B:
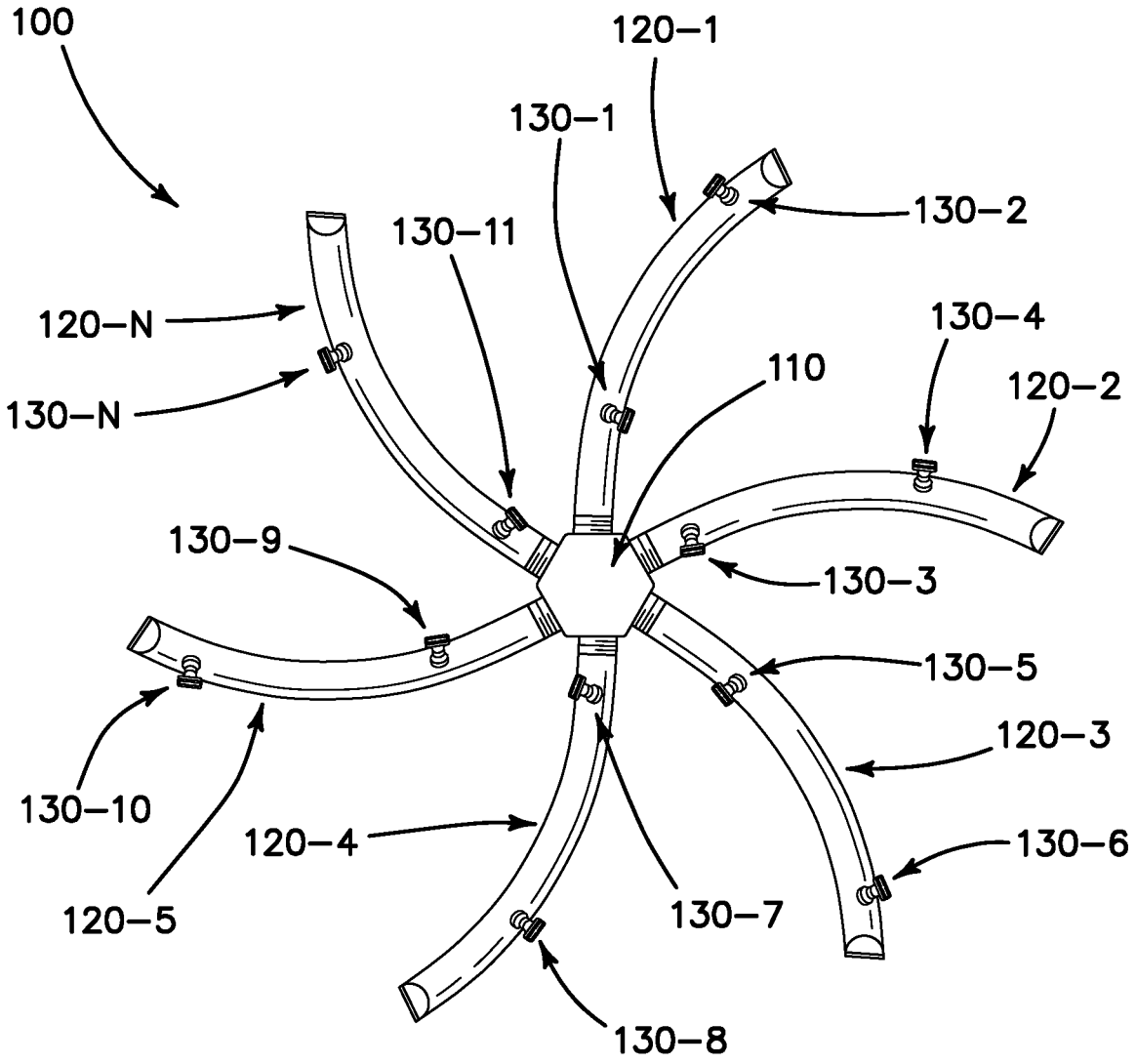

The star-shaped burner system 100 shown in FIGS. 1A-1C includes broadly a gas hub 110, gas conduits 120-1 through 120-N and gas release nozzles 130-1 through 130-N. In one embodiment, the gas conduits 120-1 through 120-N have threaded ends which engage with threaded openings in the gas hub 110. Other means for connecting the gas conduits 120-1 through 120-N to the gas hub 110 may be used. In one embodiment, the gas release nozzles 130-1 through 130-N have threaded ends which engage threaded openings in the gas conduits 120-1 through 120-N. Other means for connecting the gas release nozzles 130-1 through 130-N to the gas conduits 120-1 through 120-N may be used. As shown in FIGS. 1A and 1B, the gas release nozzles 130-1 through 130-N may be connected to the gas conduits 120-1 through 120-N at various angles relative to the vertical.

Figure 2A:
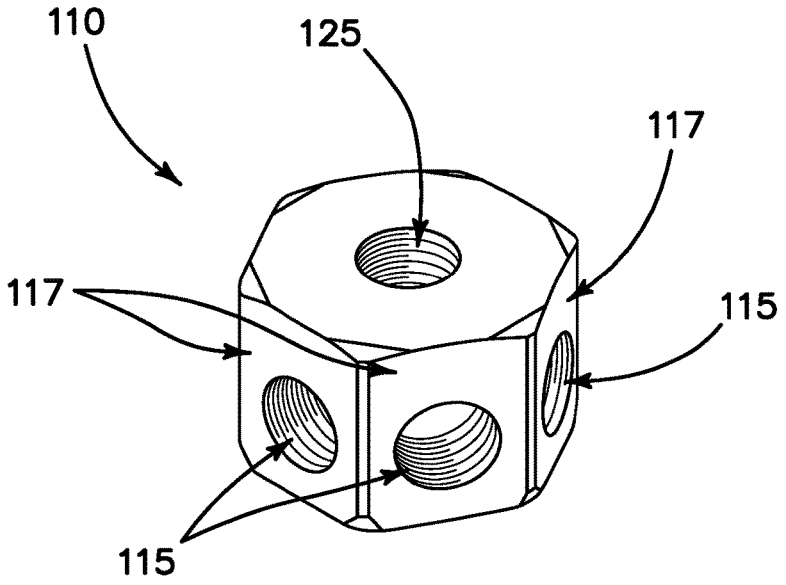
FIGS. 2A-2C illustrate upper perspective, side and top down views, respectively, views of an exemplary gas hub according to the embodiments of the present invention.
Figure 2B:
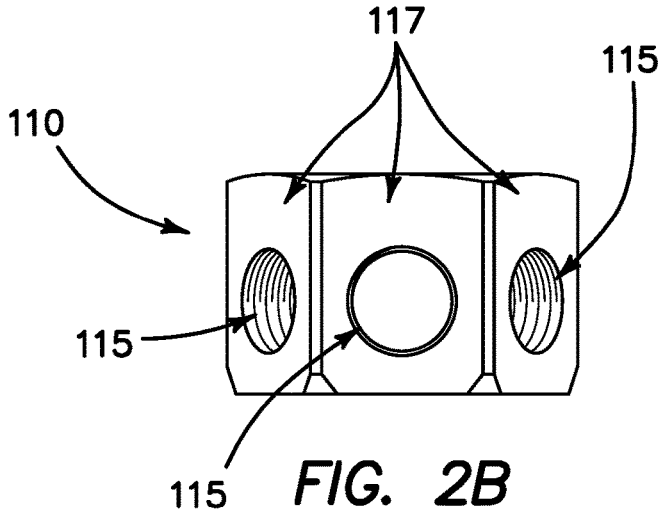
Figure 2C:
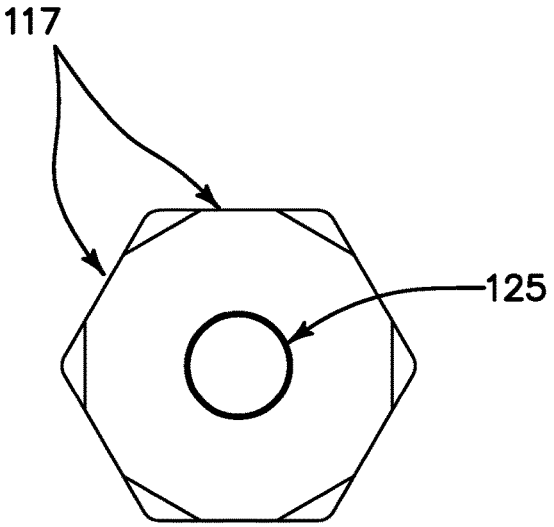
Figure 2D:
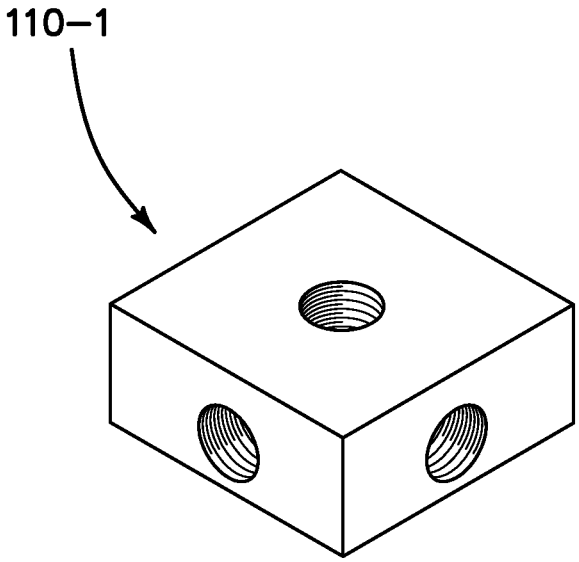
FIGS. 2D-2L illustrate various alternative gas hubs according to the embodiments of the present invention.
Figure 2E:
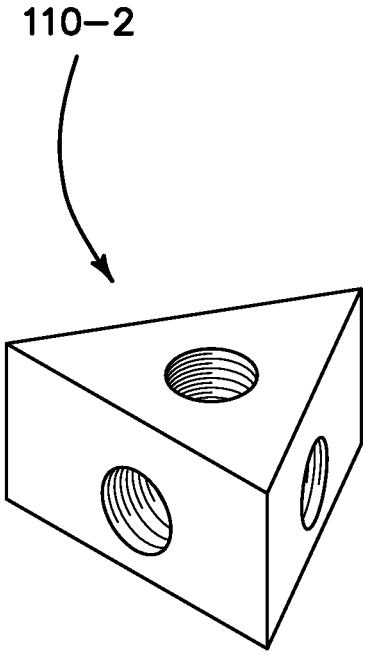
Figure 2F:
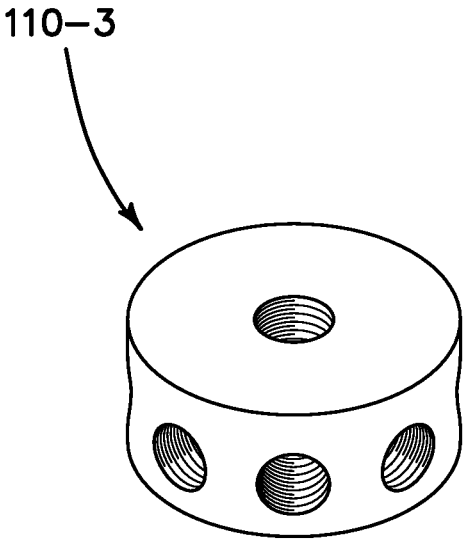
Figure 2G:
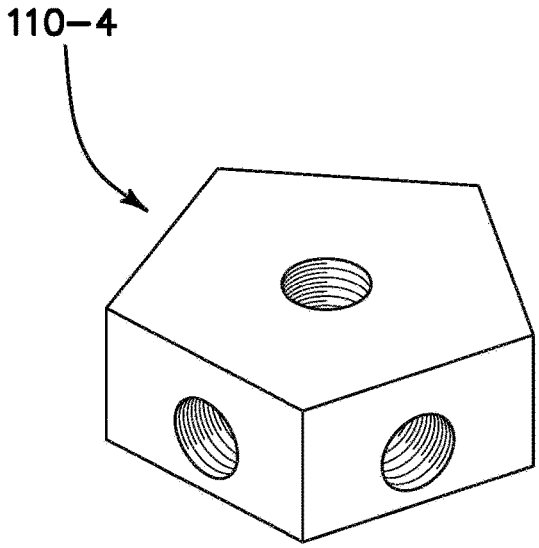
Figure 2H:
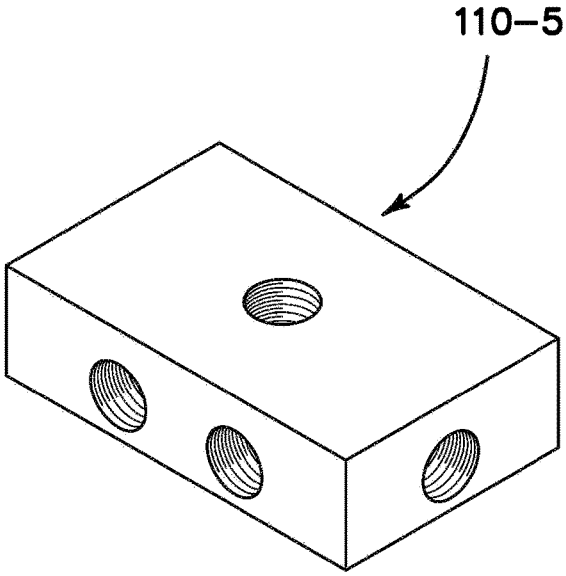
Figure 2I:
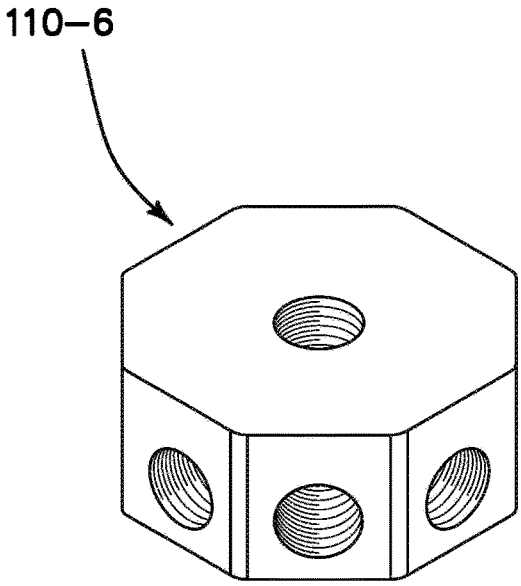
Figure 2J:
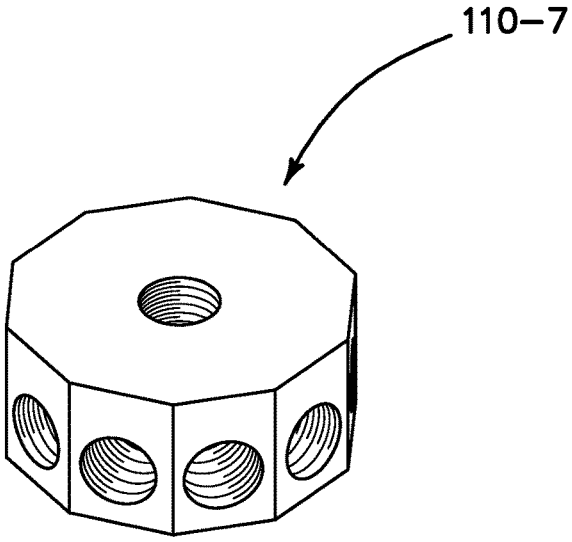
Figure 2K:
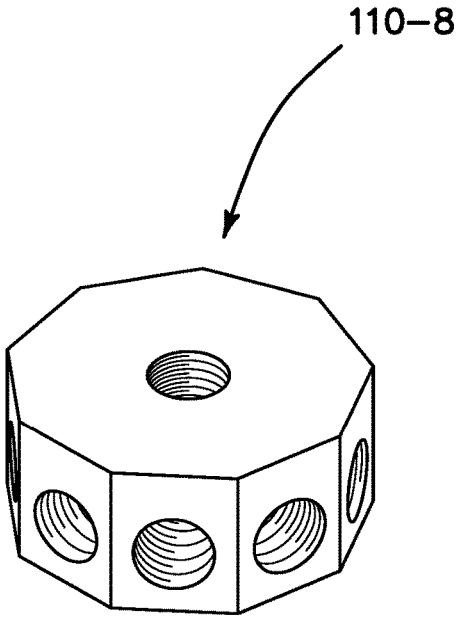
Figure 2L:
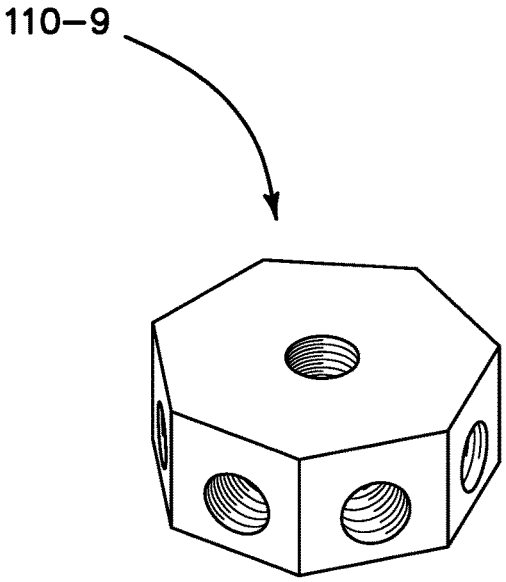

As best seen in FIGS. 2A-2C, the gas hub 110 has a hexagonal shape with six sides. As shown in FIGS. 2D through 2L, other gas hub shapes are conceivable. Gas hubs 110-1 through 110-9 are shaped as a square, triangle, circle, pentagon, rectangle, octagon, decagon, nonagon and heptagon, respectively. Threaded openings 115 in each side 117 of the gas hub 110 are configured to receive the threaded gas conduits 120-1 through 120-N. A top or bottom opening 125 in the gas hub 110 may receive a conduit leading from a gas source. The design of the gas hub 110 distributes gas evenly into the various gas conduits 120-1 through 120-N connected thereto. The distributed gas is then carried to the various gas release nozzles 130-1 through 130-N connected to the gas conduits 120-1 through 120-N.

Figure 3A:
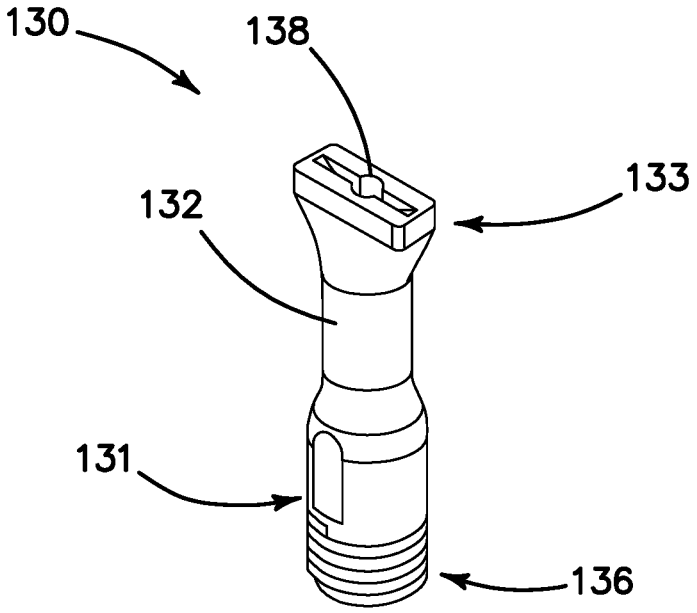
FIGS. 3A-3D illustrate upper perspective, close up, side and top down views, respectively, of a gas release nozzle according to the embodiments of the present invention.
Figure 3B:
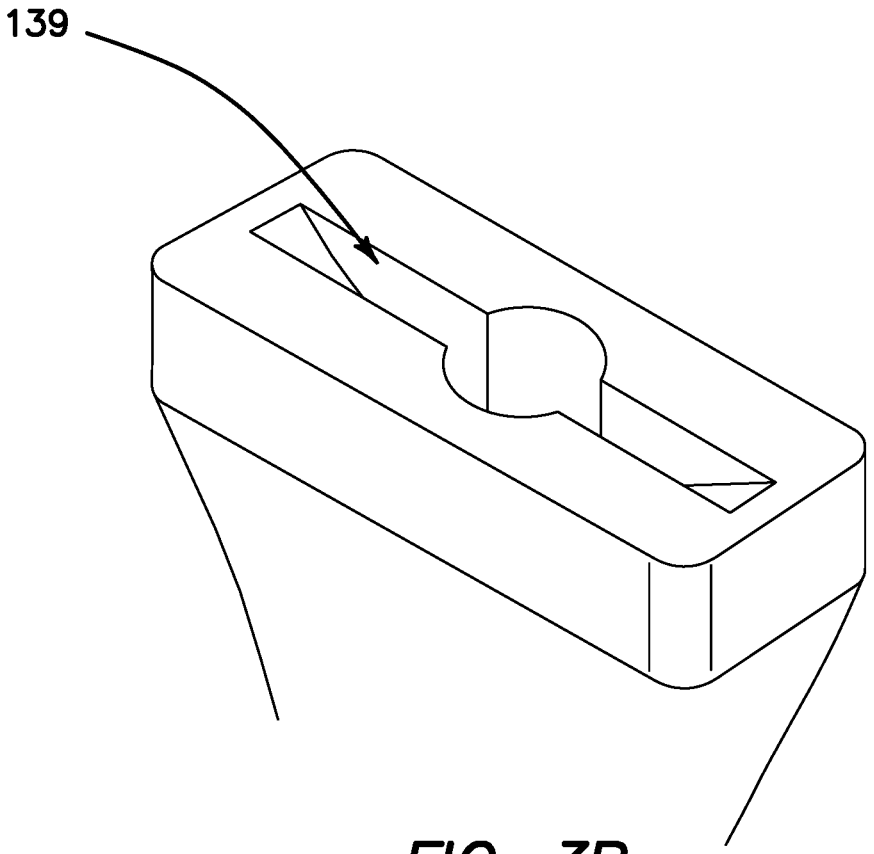
Figure 3C:
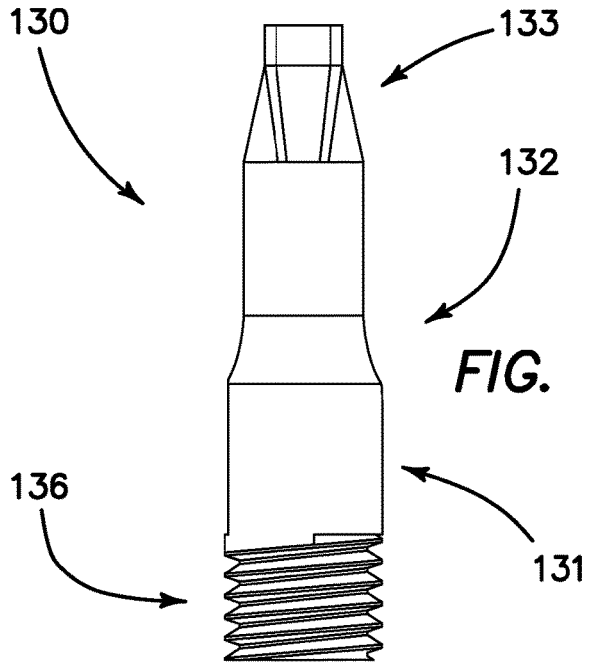
Figure 3D:
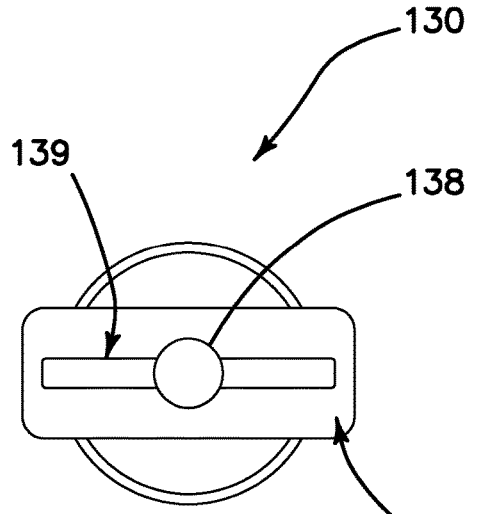
Figure 3E:
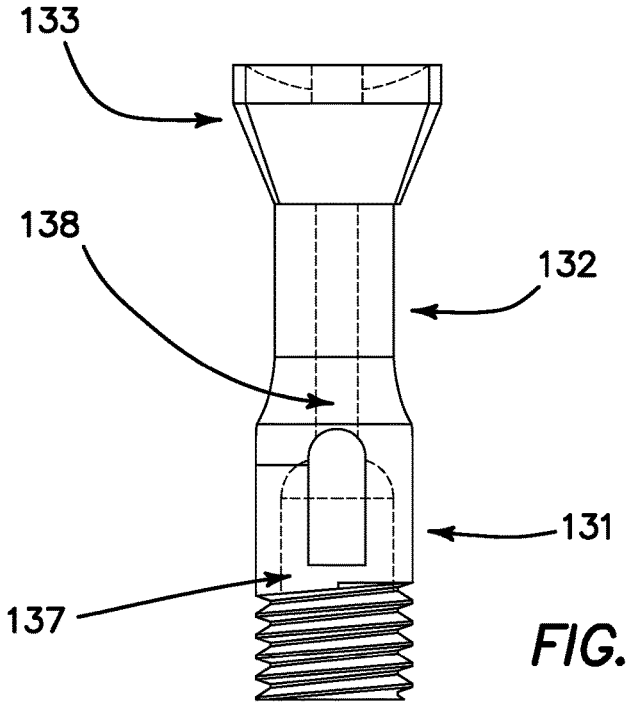
FIG. 3E illustrates a cross-sectional view of the gas release nozzle according to the embodiments of the present invention.

FIGS. 3A-3D show the gas release nozzle 130. The gas release nozzle 130 includes a lower portion 131, intermediate portion 132 and upper portion 133. The lower portion 131 includes the threaded end 136 configured to engage with the openings in the gas conduits 120-1 through 120-N. As shown in FIG. 3D, a first gas channel 137 extends through the lower portion 131 and communicates with a second gas channel 138 extending through the intermediate portion 132 and upper portion 133. The second gas channel 138 has a smaller diameter than the first gas channel 137 to compress gas as it passes through said intermediate portion 132 and upper portion 133. The upper portion 133 includes a tapered slot 139 in communication with an upper end of second gas channel 138 which serves to create a flat flame as ignited gas exits the upper portion 133 of the gas release nozzle 130. The design of the gas release nozzle 130 increases the flame height without utilizing additional gas.

Figure 4:
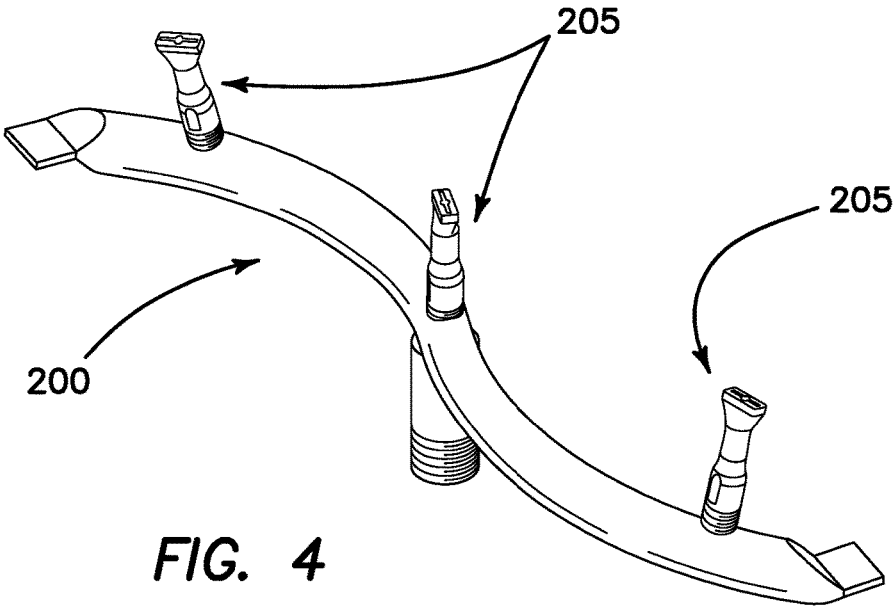
FIG. 4 illustrates an S-shaped burner system according to the embodiments of the present invention.
Figure 5:
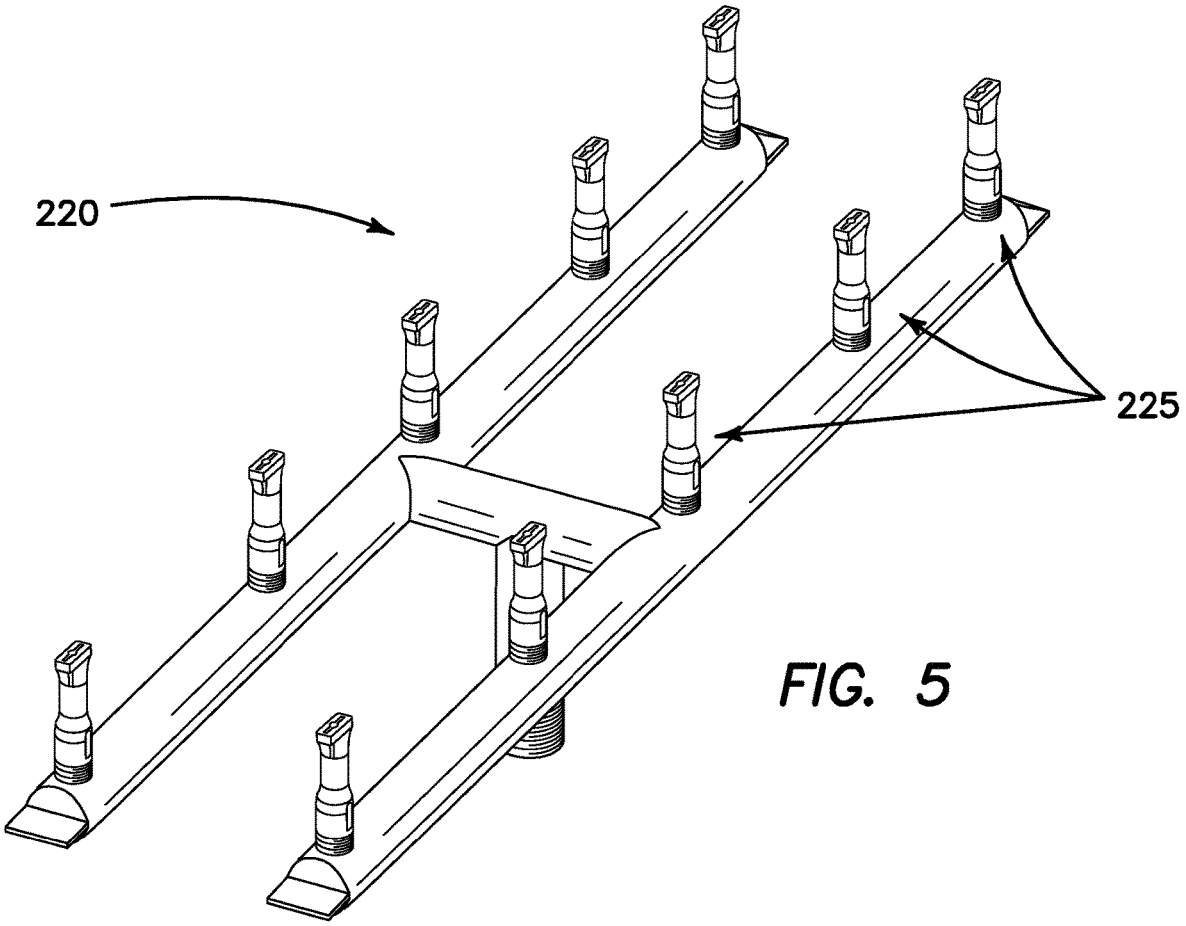
FIG. 5 illustrates an H-shaped burner system according to the embodiments of the present invention.
Figure 6:
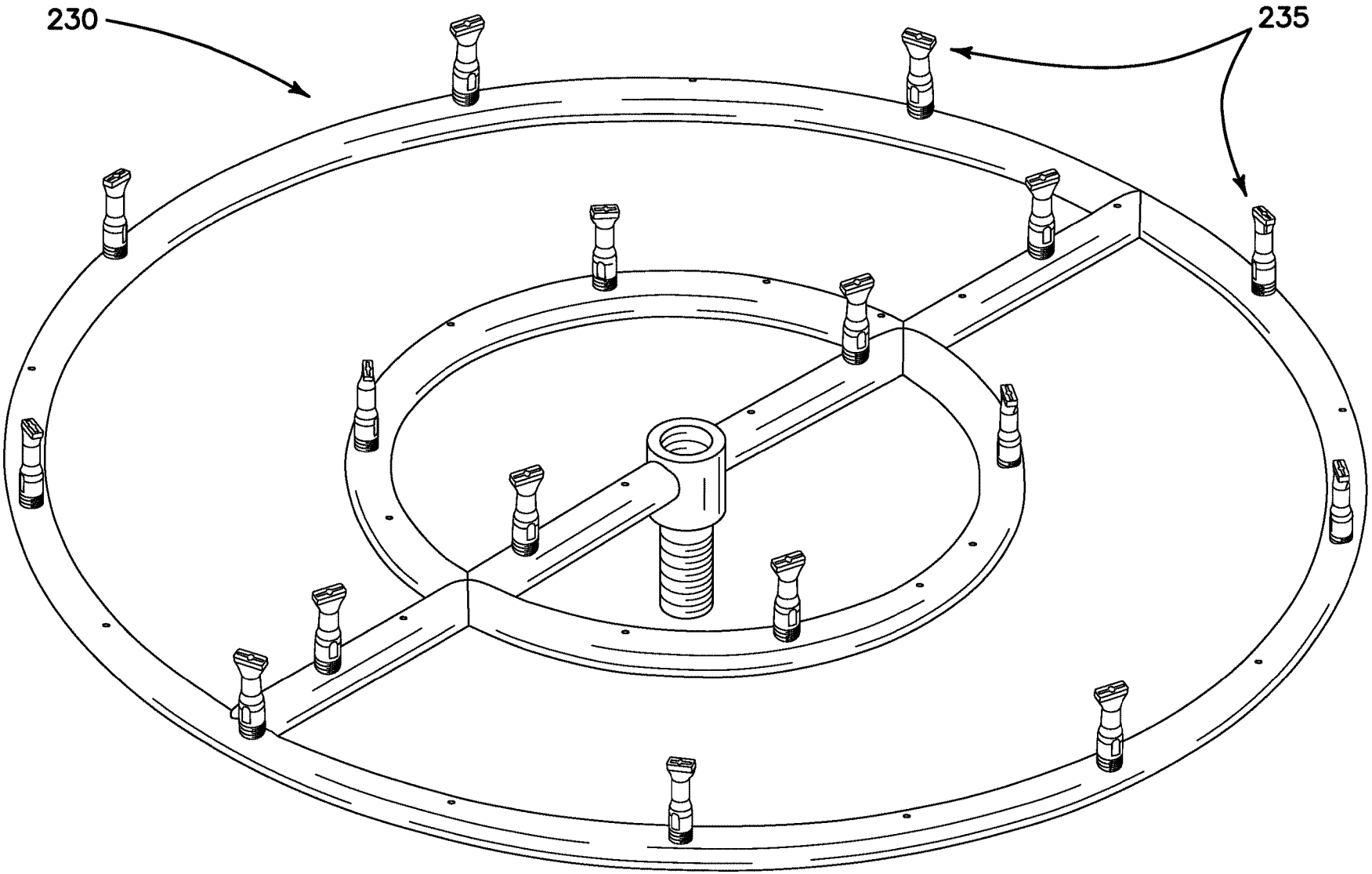
FIG. 6 illustrates a circular-shaped burner system according to the embodiments of the present invention.
Figure 7:
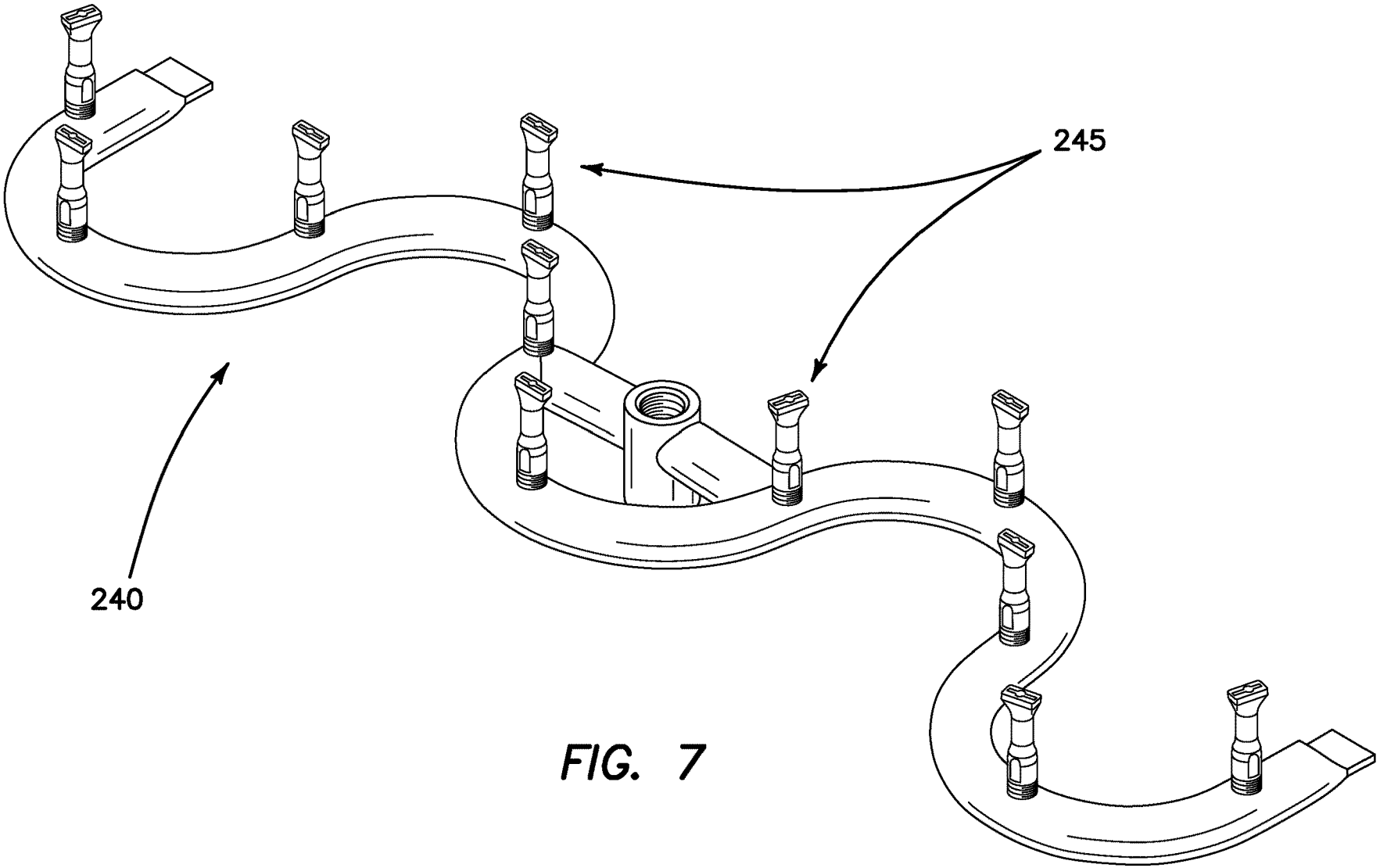
FIG. 7 illustrates a switch back burner system according to the embodiments of the present invention.
Figure 8:
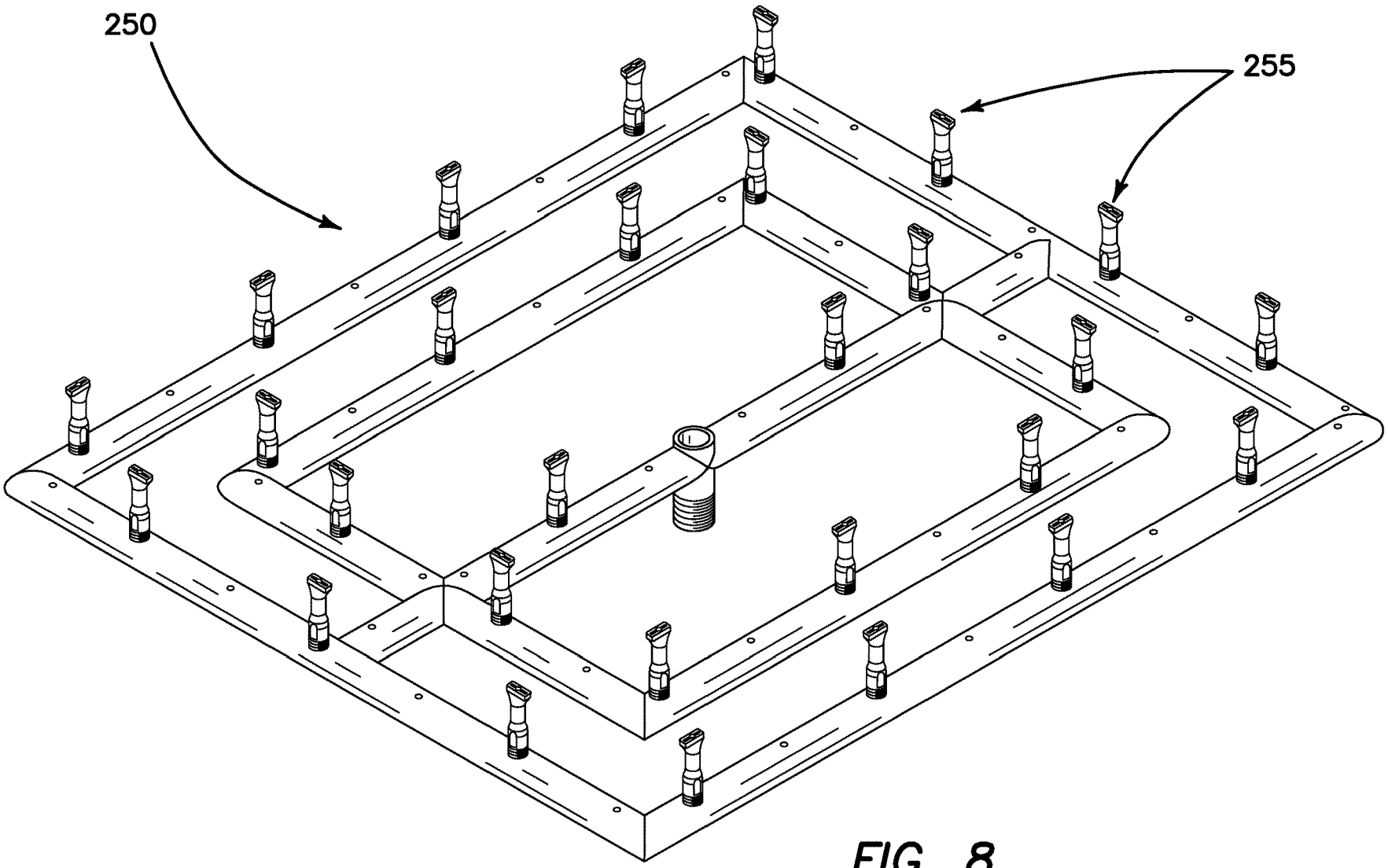
FIG. 8 illustrates a square-shaped burner system according to the embodiments of the present invention.

FIG. 4 illustrates an S-shaped burner system 200 having three gas release nozzles 205 according to the embodiments of the present invention. FIG. 5 illustrates an H-shaped burner 220 having ten gas release nozzles 225 according to the embodiments of the present invention. FIG. 6 illustrates a circular-shaped burner system 230 having eighteen gas release nozzles 235 according to the embodiments of the present invention. FIG. 7 illustrates a switch back burner system 240 having eleven gas release nozzles 245 according to the embodiments of the present invention. FIG. 8 illustrates a square-shaped burner system 250 having twenty-eight gas release nozzles 255 according to the embodiments of the present invention.

Although the invention has been described in detail with reference to several embodiments, additional variations and modifications exist within the scope and spirit of the invention as described and defined in the following claims.

I claim:

1. A burner system comprising:

a gas hub to distribute gas to one more gas conduits; and one or more gas release nozzles connected to said one or more gas conduits, said one or more gas release nozzles having a lower portion, intermediate portion and upper portion, said lower portion having a first gas channel therethrough, said intermediate portion and said upper portion having a second gas channel therethrough, said first gas channel and said second gas channel in communication with one other, said second gas channel having a smaller diameter than said first gas channel to compress gas as it passes through said intermediate portion and said upper portion, said upper portion including a tapered slot below and leading to an upper end of said second gas channel defining a flame exit opening, said flame exit opening defined by an elongated open slot with a center circular open portion which collectively permit passage of gas creating a flat flame when the gas exiting therethrough is ignited, said tapered slot decreasing a cross-section of said second gas channel.

2. The burner system of claim 1 wherein said gas hub is shaped as a hexagon, square, triangle, circle, pentagon, rectangle, octagon, decagon, nonagon and heptagon.

3. The burner system of claim 2 wherein each side of said gas hub includes a threaded opening for receipt of a threaded end of a gas conduit.

4. The burner system of claim 1 wherein said gas hub includes an opening for receipt of a gas source.

5. The burner system of claim 1 wherein said one or more gas release nozzles are connected to said one or more gas conduits at an angle relative to a vertical plane.

6. A burner system comprising:

a gas hub to distribute gas to one more gas conduits;

one or more gas release nozzles connected to said one or more gas conduits, said one or more gas release nozzles having a lower portion, intermediate portion and upper portion, said lower portion having a first gas channel therethrough, said intermediate portion and said upper portion having a second gas channel therethrough, said first gas channel and said second gas channel in communication with one other, said second gas channel having a smaller diameter than said first gas channel to compress gas as it passes through said intermediate portion and said upper portion, said upper portion including a tapered slot below and leading to an upper end of said second gas channel defining a flame exit opening, said flame exit opening defined by an elongated open slot with a center circular open portion which collectively permit passage of gas creating flat flame when the gas exiting therethrough is ignited, said tapered slot decreasing a cross-section of said second gas channel; and wherein said gas hub has multiple sides each having a threaded opening for receipt of a threaded end of one of said one or more gas conduits, and said one or more gas conduits having one or more threaded openings for receipt of a threaded end of one of said one or more of said gas release nozzles.

7. The burner system of claim 6 wherein said gas hub is shaped as a hexagon, square, triangle, circle, pentagon, rectangle, octagon, decagon, nonagon and heptagon.

8. The burner system of claim 6 wherein said gas hub includes an opening for receipt of a gas source.

9. The burner system of claim 6 wherein said one or more gas release nozzles are connected to said one or more gas conduits at an angle relative to a vertical plane.

* * * * *